US009080294B2

(12) United States Patent
Jonker et al.

(10) Patent No.: US 9,080,294 B2
(45) Date of Patent: Jul. 14, 2015

(54) PICK ASSEMBLY, PICK HOLDER FOR SAME, PICK TOOL FOR SAME AND STRIKE ELEMENT FOR SAME

(75) Inventors: Cornelis Roelof Jonker, Springs (ZA); Bernd Heinrich Ries, Huenfeld (DE); Frank Friedrich Lachmann, Burghaun (DE)

(73) Assignees: Element Six GmbH, Burghaun (DE); Element Six Abrasives S.A., Luxembourg (LU)

( * ) Notice: Subject to any disclaimer, the term of this patent is extended or adjusted under 35 U.S.C. 154(b) by 10 days.

(21) Appl. No.: 14/007,323

(22) PCT Filed: Mar. 28, 2012

(86) PCT No.: PCT/EP2012/055495

§ 371 (c)(1),
(2), (4) Date: Sep. 24, 2013

(87) PCT Pub. No.: WO2012/130870

PCT Pub. Date: Oct. 4, 2012

(65) Prior Publication Data

US 2014/0015305 A1 Jan. 16, 2014

Related U.S. Application Data

(60) Provisional application No. 61/470,049, filed on Mar. 31, 2011.

(30) Foreign Application Priority Data

Mar. 31, 2011 (GB) ..... 1105438.4

(51) Int. Cl.
*E01C 23/088* (2006.01)
*E21C 35/18* (2006.01)
(Continued)

(52) U.S. Cl.
CPC ..... *E01C 23/088* (2013.01); *E01C 23/127* (2013.01); *E02F 3/20* (2013.01); *E02F 9/2866* (2013.01); *E21C 35/18* (2013.01); *E21C 35/183* (2013.01)

(58) Field of Classification Search
CPC ..... E01C 23/088; E01C 23/127; E21C 35/18; E21C 35/183; E02F 3/20; E02F 9/2866
USPC ..... 299/39.4, 39.5, 39.6, 39.7, 39.8, 79.1, 299/85.1, 80.1, 82.1, 83.1, 83.2, 101, 105, 299/106, 108, 110, 111, 112 R, 112 T, 113
See application file for complete search history.

(56) References Cited

U.S. PATENT DOCUMENTS 4,614,379 A 9/1986 Wirtgen
5,378,050 A * 1/1995 Kammerer et al. ..... 299/102
(Continued)

FOREIGN PATENT DOCUMENTS

DE 19504495 A1 8/1996
DE 202005001311 3/2005
(Continued)

OTHER PUBLICATIONS

United Kingdom Application No. GB1105438.4, Search Report mailed on Apr. 21, 2011, 7 pages.
(Continued)

*Primary Examiner* — John Kreck
*Assistant Examiner* — Carib Oquendo
(74) *Attorney, Agent, or Firm* — Dean W. Russell; Clark F. Weight; Kilpatrick Townsend & Stockton LLP

(57) ABSTRACT

A pick assembly (100) comprising a pick tool (200), a pick holder (300) and a rotatable drive means (400); in which the pick holder is attached to the rotatable drive means and the pick tool comprises a base (220) and a strike element (210) capable of being attached to the base, the strike element comprising a strike tip (212) defining a strike tip axis (213) and the base capable of being attached to the pick holder; the pick holder and pick tool being configured in relation to the drive means operative to the strike tip axis being oriented to within a strike angle of at most 5 degrees with a strike plane on which the strike tip will travel when driven by the drive means.

18 Claims, 3 Drawing Sheets

(51) Int. Cl.

| | |
|---|---|
| ***E02F 3/20*** | (2006.01) |
| ***E02F 9/28*** | (2006.01) |
| ***E01C 23/12*** | (2006.01) |
| ***E21C 35/183*** | (2006.01) |

(56) References Cited

U.S. PATENT DOCUMENTS

| | | | | |
|---|---|---|---|---|
| 6,619,756 | B1 | 9/2003 | Holl et al. | |
| 7,396,086 | B1 | 7/2008 | Hall et al. | |
| 7,401,863 | B1 * | 7/2008 | Hall et al. | 299/95 |
| 7,475,949 | B2 * | 1/2009 | Helsel et al. | 299/108 |
| 7,490,912 | B2 * | 2/2009 | Holl | 299/106 |
| 7,784,875 | B2 * | 8/2010 | Holl et al. | 299/102 |
| 2005/0088034 | A1 * | 4/2005 | Clemenson | 299/106 |
| 2006/0071538 | A1 | 4/2006 | Sollami | |
| 2008/0036272 | A1 | 2/2008 | Hall et al. | |
| 2008/0129104 | A1 | 6/2008 | Hall et al. | |
| 2008/0164072 | A1 | 7/2008 | Hall et al. | |
| 2008/0282584 | A1 | 11/2008 | Hall et al. | |
| 2012/0261977 | A1 * | 10/2012 | Hall et al. | 299/100 |

FOREIGN PATENT DOCUMENTS

| | | | |
|---|---|---|---|
| DE | 202007013350 | | 3/2008 |
| EP | 2189753 | A2 | 5/2010 |
| GB | 1212200 | | 11/1970 |
| WO | 0057024 | A1 | 9/2000 |
| WO | 2011004030 | A2 | 1/2011 |

OTHER PUBLICATIONS

United Kingdom Application No. GB1205434.2, Search Report mailed on Jun. 27, 2012, 7 pages.

International Application No. PCT/EP2012/055495, International Search Report and Written Opinion mailed on Aug. 1, 2012, 15 pages.

* cited by examiner

PICK ASSEMBLY, PICK HOLDER FOR SAME, PICK TOOL FOR SAME AND STRIKE ELEMENT FOR SAME

CROSS REFERENCE TO RELATED APPLICATIONS

This application is the U.S. national phase of International Application No. PCT/EP2012/055495 filed on Mar. 28, 2012, and published in English on Oct. 4, 2012 as International Publication No. WO 2012/130870 A1, which application claims priority to Great Britain Patent Application No. 1105438.4 filed on Mar. 31, 2011 and U.S. Provisional Application No. 61/470,049 filed on Mar. 31, 2011, the contents of all of which are incorporated herein by reference.

This disclosure relates generally to pick assemblies, particularly but not exclusively for degrading hard or abrasive bodies, such as rock, asphalt, coal or concrete, for example; and to components for same, including pick holders, pick tools and strike elements.

Pick tools may be used for breaking, boring into or otherwise degrading structures or bodies, such as rock, asphalt, coal or concrete and may be used in applications such as mining, construction and road reconditioning. For example, in road reconditioning operations, a plurality of pick tools may be mounted on a rotatable drum and driven against road paving to break it up as the drum is rotated. A similar approach may be used to break up rock formations such as in coal mining. Pick tools for road planing, soil stabilisation, asphalt reclamation, drilling, tunnel boring, surface mining and other heavy duty mining and construction applications generally comprise cemented tungsten carbide tips. These tips tend to deteriorate by wear during use.

United States patent number 2006/0071538 explains that machines for cutting hard surfaces, such as used in the trenching and mining industries and for removing the upper surfaces of concrete and asphalt pavement, employ tools fitted into tool bases on a rotatable drum. The tools comprise a cylindrical shank that rotatably fits within a complementarily shaped bore in the tool base. Force is applied through the rotating drum to the tool base and the tool to thereby force the tool into the hard surface to be cut. During the operation of such machines, the useful life of the tools is enhanced by the rotation of the tool, causing it to wear evenly around its circumference. The tools are mounted at an angle of about seven degrees on the drum and the contact of the tool body with the surface to be cut applies a component of force to the side of the tool that is perpendicular to the axis of rotation.

Drums for road milling or mining may be supplied commercially with a plurality of pick holders welded onto the curved surface of the drum and pick tools may be releasably mounted onto the holders. When a pick tool needs to be replaced due to wear in use, it can be removed from its holder and replaced by mounting a new pick onto the holder. In order to promote the rotation of each pick tool about its own axis in use, the pick holders will be attached to the drum such that they are misaligned to some degree from a strike plane that is perpendicular to the axis of rotation of the drum. The degree of misalignment may be referred to as the offset angle.

There is a need for pick tools having an enhanced efficiency and a long working life.

Viewed from a first aspect there is provided a pick assembly comprising a pick tool, a pick holder and a rotatable drive means such as a drum; in which the pick holder is attached to the rotatable drive means and the pick tool comprises a base and a strike element capable of being attached to a base, the strike element comprising a strike tip defining a strike tip axis and the base capable of being attached to the pick holder; the pick holder and pick tool being configured in relation to the drive means operative to (i.e. when the pick assembly is in an assembled condition and in use) the strike tip axis being oriented to within a strike angle of at most 5 degrees, at most 2 degrees or at most 1 degree with a strike plane on which the strike tip will travel when driven by the drive means; or the strike tip axis may be substantially aligned with the strike plane. The pick assembly may be for degrading pavement, rock formations, for example.

In other words, when the pick tool is attached to the pick base and the assembly is in use, the rotating drive means (being driven by a vehicle) will drive the pick tool such that the strike tip will follow an arcuate path on a strike plane that is perpendicular to the axis of rotation of the drive means. The strike element, base and pick holder are arranged in relation to the drive means such that the strike tip axis may be substantially parallel with the strike plane (i.e. aligned in the strike plane).

Various example arrangements and combinations are envisaged by this disclosure, and non-limiting and non-exhaustive examples are described below.

The strike element may comprise the strike tip (which may also be referred to as a pick tip) joined to a support body, such as by means of a braze join, and the strike tip may comprise a polycrystalline diamond strike structure joined to a substrate. The substrate and or the support body may comprise cemented carbide material. The strike structure may define a conical side surface and comprise an apex, which may be rounded (blunted) to provide a blunted conical distal strike end opposite a proximate end. The strike tip may be substantially rotationally symmetric about the strike tip axis, which may pass through the proximate end and the apex at the distal end. The strike tip axis may be a longitudinal axis through the strike tip.

The strike element may comprise a super-hard strike tip, which may be joined to an elongate support body and may be referred to as a pick insert. The base may comprise a bore configured to receive the support body and the part of the support body configured to fit into the bore may be referred to as an insertion shank. The strike element may be non-rotatably attached to the base. In some example arrangements, the support body may comprise a elongate member or shank portion, which may be press fit or shrink fit into a bore provided in the base, the bore being configured to accommodate the support body.

The strike tip may have opposite ends connected by a peripheral side surface and the strike tip axis may pass through both ends, concentric with the peripheral side surface. The strike tip may be rotationally symmetrical about the strike tip axis. The strike tip may comprise a conical surface and rounded apex and the strike tip axis may pass through the apex.

The strike tip may be joined to an elongate support body and the base may comprise a bore for accommodating the support body, the support body being securable in the bore by means of an interference fit such as a press or shrink fit.

The strike tip may comprise super-hard material such as diamond, cubic boron nitride, silicon carbide bonded diamond material or polycrystalline diamond (PCD) material. The strike tip may comprise a super-hard strike structure joined to a cemented carbide substrate, the strike structure defining a working end having a conical surface region and a rounded central apex.

The drive means is a drum configured to be driven by a vehicle. The pick assembly may be for road milling or mining.

In some example arrangements the pick holder may be attached to the drive means such that the pick holder is misaligned from the strike plane by an offset angle, which may be at least about 5 degrees or at least about 7 degrees. The pick holder may be arranged with respect to the drive means for inducing rotational moment on a rotatably mounted pick tool in use (i.e. for tending to cause or causing the rotatably mounted pick to rotate about its own axis, which may be the strike tip axis, in use). The base and or the strike element may be configured such that when the base is attached to the pick holder, the offset angle is compensated and the strike tip axis will be substantially aligned with the strike plane when in use.

The pick holder may be attached to the drive means such that the pick holder is misaligned from the strike plane by an offset angle, the pick holder being configured such that when the pick tool is attached to the pick holder, the offset angle is at least partly compensated such that the strike tip axis is oriented to within a strike angle of at most 5 degrees with the strike plane. In other words, the compensation may be such that the angle by which the strike tip is misaligned from the strike plane will be reduced or substantially eliminated.

The pick holder may comprise a bore for accommodating a shaft extending from the base of the pick tool, the bore of the pick holder and the shaft being cooperatively configured for attachment of the pick tool to the pick holder; the bore being arranged such that when the pick tool is attached to the pick holder, the offset angle is at least partly compensated such that the strike tip axis is oriented to within a strike angle of at most 5 degrees with the strike plane or substantially aligned with the strike plane.

The pick holder may be attached to the drive means such that the pick holder is misaligned from the strike plane by an offset angle, the pick tool being configured such that when the attached to the pick holder, the offset angle is at least partly compensated such that the strike tip axis is oriented to within a strike angle of at most 5 degrees with the strike plane or substantially aligned with the strike plane.

In example arrangements, the base may comprise a shaft for connection to the pick holder In some example arrangements, the shaft and the bore may be respectively positioned to provide a compensation angle to compensate for an offset angle relative to a strike plane such that the longitudinal axis, in use, is constrained to travel substantially in the strike plane or the strike tip axis is oriented to within a strike angle of at most 5 degrees with the strike plane.

The base of the pick tool may be configured such that when the pick tool is attached to the pick holder, the offset angle is at least partly compensated such that strike tip axis is oriented to within a strike angle of at most 5 degrees with the strike plane or substantially aligned with the strike plane.

The strike element may comprise a strike tip joined to a support body and be configured such that the strike tip axis is oriented at a non-zero angle from an axis defined by the support body such that when the pick assembly is in assembled as in use, the strike tip axis is oriented to within a strike angle of at most 5 degrees with the strike plane or substantially aligned with the strike plane. The non-zero angle may be at least about 1 degree, at least about 2 degrees or at least about 5 degrees.

The pick holder may be aligned with the strike plane. In other words, the pick holder may be arranged with respect to the drive means such that a substantial rotational moment will not be induced on a rotatably mounted pick tool in use.

The strike tip may comprises PCD material joined to a carbide substrate, the strike element may comprise the strike tip joined to a support body comprising an elongate insertion shank; the base may comprise steel and have a bore for accommodating the insertion shank and holding it by means of an interference fit.

The pick assembly may comprise a plurality of pick tools attached to a drum for mining or road milling by means of a respective plurality of pick holders. At least some of the pick assemblies may arranged such that the respective strike tip axes are oriented to within different strike angles of at most 5 degrees with the strike plane. Some of the strike tip axes may be substantially aligned with the strike plane.

Viewed from a second aspect there is provided a pick holder for a pick assembly according to this disclosure, the pick holder being configured such that the strike tip axis is oriented to within a strike angle of at most 5 degrees with the strike plane when the pick assembly is assembled as in use, or is substantially aligned with the strike plane. Various arrangements for pick holders are envisaged by this disclosure, including example pick holder arrangements disclosed herein.

Viewed from a third aspect there is provided a pick tool for a pick assembly according to this disclosure, the pick tool being configured such the strike tip axis is oriented to within a strike angle of at most 5 degrees with the strike plane when the pick assembly is assembled as in use, or is substantially aligned with the strike plane. Various arrangements for pick tools are envisaged by this disclosure, including example pick tool arrangements disclosed herein.

Viewed from a fourth aspect there is provided a strike element for a pick assembly according to this disclosure, the strike element being configured such the strike tip axis is oriented to within a strike angle of at most 5 degrees with the strike plane when the pick assembly is assembled as in use, or is substantially aligned with the strike plane. Various arrangements for strike elements are envisaged by this disclosure, including example strike element arrangements disclosed herein.

In some example arrangements, the pick holder may be attached to the drive means such that the pick holder is substantially aligned with the strike plane.

Pick assemblies according to this disclosure are likely to have the aspect of enhanced pick efficiency owing to increased alignment of the strike tip axis with the strike plane. Certain example pick assemblies are likely to increase the flexibility associated with a given pick system.

Non-limiting example arrangements will be described below with reference to the accompanying drawings, of which FIG. 1 is a schematic side view of part of an example pick assembly in assembled condition, in which the pick base is shown in cross-section;

Figure 1:
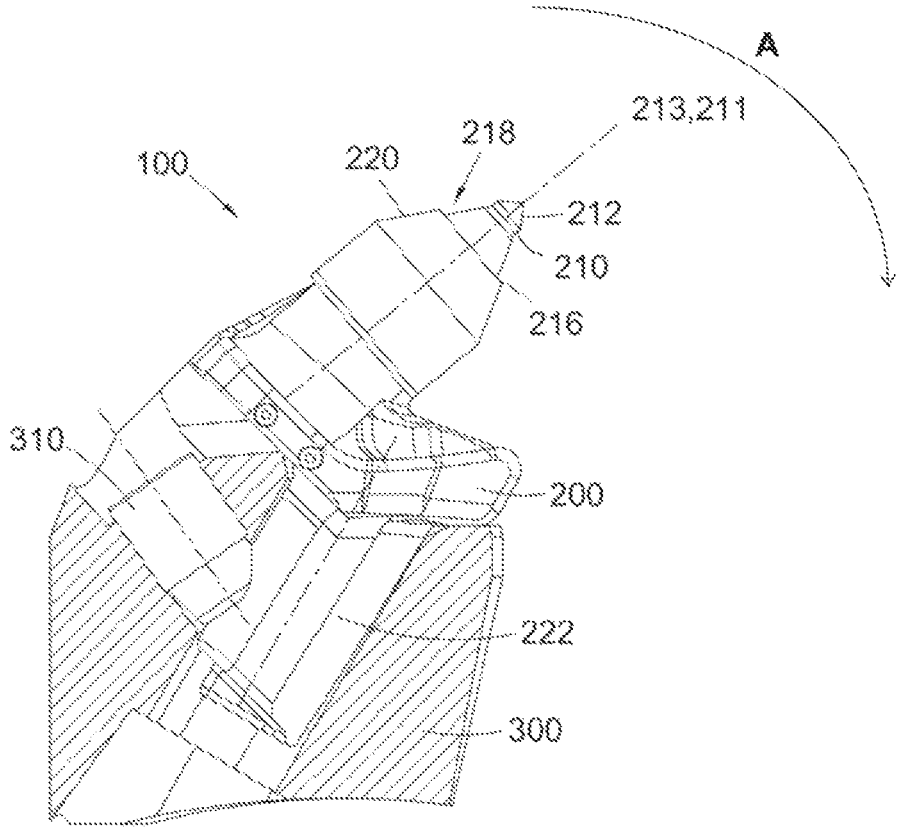
Figure 2:
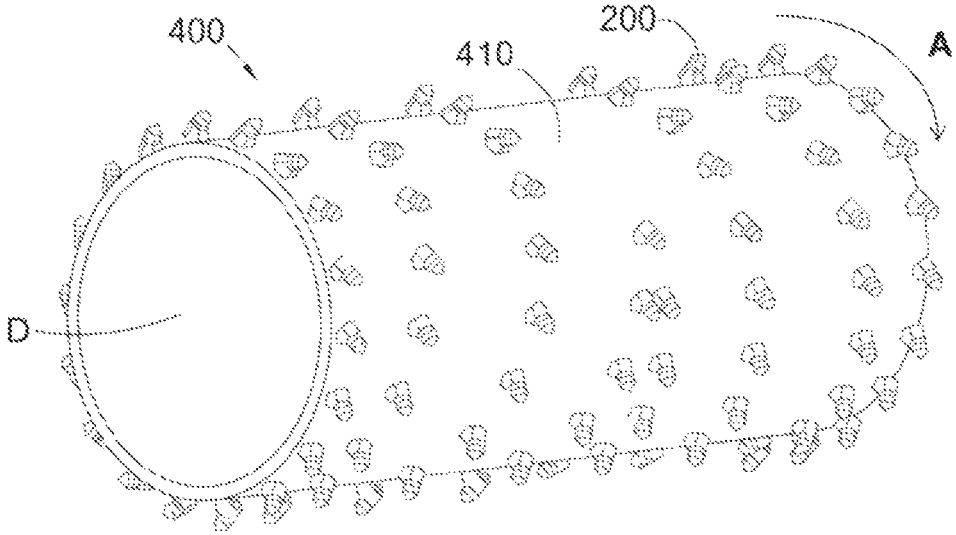
FIG. 2 is a schematic perspective view of an example pick assembly.

With reference to FIG. 1, an example pick assembly 100 comprises a pick tool 200 and a pick holder 300 that is welded to a road milling drum (not shown in FIG. 1). An example pick assembly including a drum 400 is illustrated in FIG. 2, in which a plurality of pick tools 200 is attached to the curved surface 410 of the drum 400 via respective pick holders. The axis D of rotation of the drum 400 extends along the central axis of the drum 400, parallel to it's curved surface 410.

With further reference to FIG. 1, the example pick tool 200 comprises a strike element 210 and a steel base 220. The strike element 210 comprises a strike tip 212 braze joined to a frusto-conically shaped end of a generally cylindrical cemented carbide support body, which is shrink fitted into a bore 218 provided in the base 220 (the frusto-conical portion of the support body is evident in FIG. 1, protruding from the mouth 216 of the bore of the base 220). The portion of the support body that is inserted into the bore 218 may be referred to as the insertion shank. In general, the insertion shank may have any of various shapes when viewed in transverse cross-section. For example, the insertion shank transverse cross-section may be generally circular, elliptical, ovoid, wedge-shaped, square, rectangular, polygonal or semi-circular in shape; or the cross-sectional shape of the insertion shank may vary along its length.

The strike tip 212 comprises a PCD structure joined to a cemented carbide substrate, the PCD structure defining a generally conical strike surface including a spherically blunted central apex. The strike tip 212 defines a strike tip axis 213 passing through the apex at one end and an opposite end at which the strike tip 212 is brazed to the end of the support body. The support body defines a support body axis 211 passing through frusto-conical end and an opposite end inserted in the bore 218. In the example illustrated in FIG. 1, the strike tip 212 is rotationally (cylindrically) symmetric about the strike tip axis 213 and the support body is rotationally (cylindrically) symmetric about the support body axis and the strike tip, the strike tip axis 213 lying on the support body axis 211.

Figure 3A:
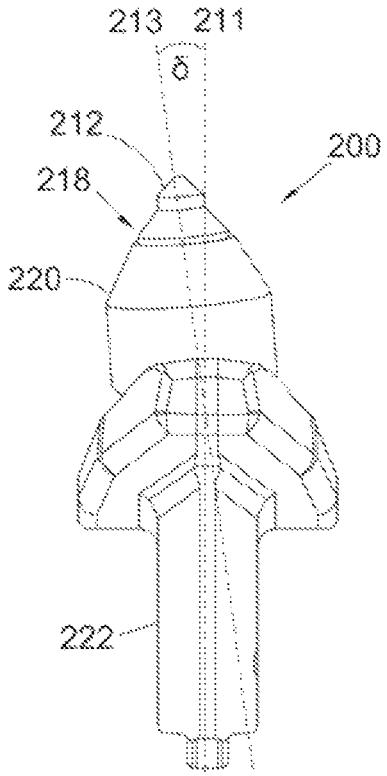
FIG. 3A and FIG. 3B show schematic front views of example pick tools.

The base 220 comprises a shaft 222 and the pick holder 300 comprises a bore 218 for accommodating the shaft 222 as illustrated in FIG. 1 and FIG. 3A, in which the general position of the bore 218 is indicated. The base 200 is attached to the pick holder 300 by the shaft 222 being inserted into the bore 218 and secured in the bore by a grub screw 310 that contacts the shaft 222 of the base 220 when it is positioned in the pick holder 300. In use, the drum will rotate and drive the strike tip 212 to travel along an arcuate path arc A (indicated schematically in FIG. 1 and FIG. 2), which defines a strike plane that will be perpendicular to the axis of rotation. When assembled, the components of the pick assembly 100 cooperate to orient the strike tip axis 213 relative to the strike plane. The angle between the strike tip axis 213 and the strike plane is referred to as the strike angle. Example arrangements of pick assemblies according to this disclosure may be configured such that the strike tip axis 213 is substantially aligned in the strike plane, or oriented at an angle of at most five degrees, at most about two degrees or at most about one degree out of the strike plane.

Figure 3B:
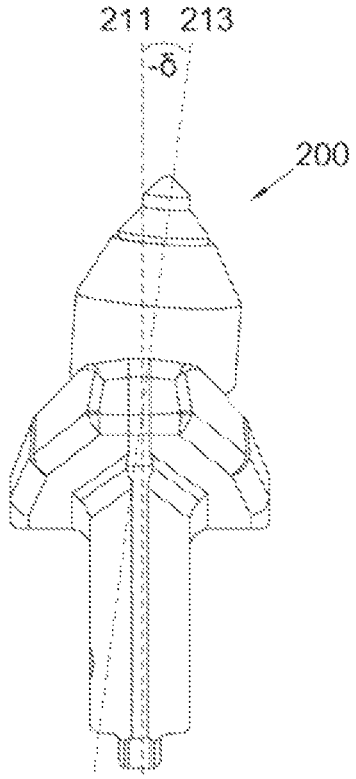
Figure 3C:
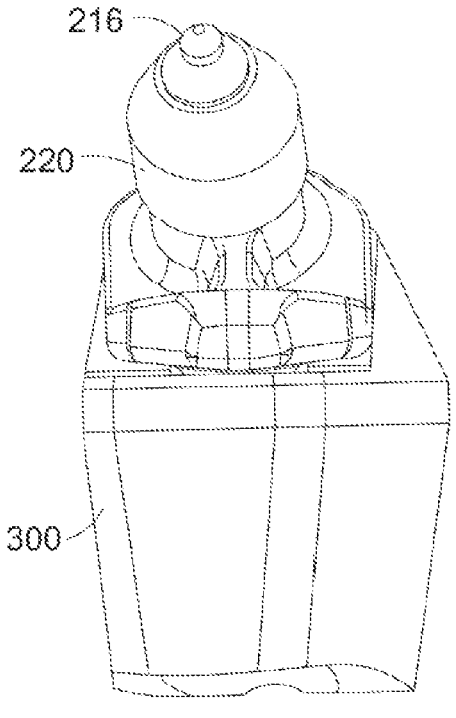
FIG. 3C shows a schematic side view of the example shown in FIG. 3A when mounted onto a pick holder.

Some example pick tools may the configured to compensate for the offset angle partially or fully by which the pick holders may be misaligned with the strike plane (for example, the drum and the pick holders welded onto the drum may be intended for use with rotatable pick tools comprising cemented carbide strike tips). With reference to FIG. 3A and FIG. 3B, the base 200 of the pick assembly compensates for the original offset angle by dint of the base bore 218 being relatively more aligned with the strike plane, or the base bore 218 being fully aligned with the strike plane. The bore 218 is therefore configured to receive the insertion shank of a strike element 210 in which the strike tip axis 213 and support body axis 211 are aligned, so that the support body axis 211 is also in increased alignment with the strike plane, possibly in full alignment in the strike plane. This can be achieved by forming the bore 218 at a compensation angle δ with respect to the shaft 222. Therefore, insertion of a strike element 210 in which the support body axis 211 and the strike tip axis 213 are aligned will result in the strike tip axis 213 being in increased alignment with the strike plane, or in full alignment with the strike plane. The pick tools shown in FIG. 3A and FIG. 3B are both examples of the same principle, differing only in the direction of the compensation angle δ, making each suitable for use with pick holders misaligned with the strike plane by the same amount but in opposite directions, as may be the case for pick holders arranged on different sides of the drum (i.e. the left hand side and the right hand side). In other words, FIGS. 3A and 3B depict pick tools that are right and left handed, so that they can compensate the alignment in opposite directions. FIG. 3C illustrates the pick tool of FIG. 3A mounted onto an example pick holder 300.

In some example arrangements, the shaft 222 of the base 220 may be configured to cooperate with the pick holder bore 300 so as to provide the compensation angle and increase the alignment of the base bore 218 and therefore the strike tip axis 213 with the strike plane.

Compensating for the offset in pre-existing drum and pick holder assemblies by using a compensating base 220 according to this disclosure is likely to reduce the cost of changing from systems that rotated the strike tip, and so require the axis of the strike tip to be aligned out of the strike plane, to systems in which the strike tip comprises super-hard material and does not need to be rotated about its own axis in use. The assemblies enabled by this disclosure are likely to exhibit increased picking efficiency by increasing alignment of the axis of the strike tip with the strike plane, possibly aligning the axis of the strike tip with the strike plane, while allowing the use of known pick holders and strike elements. Using the bases 220 of this disclosure to replace prior art strike element bases will result in these features.

Figure 4:
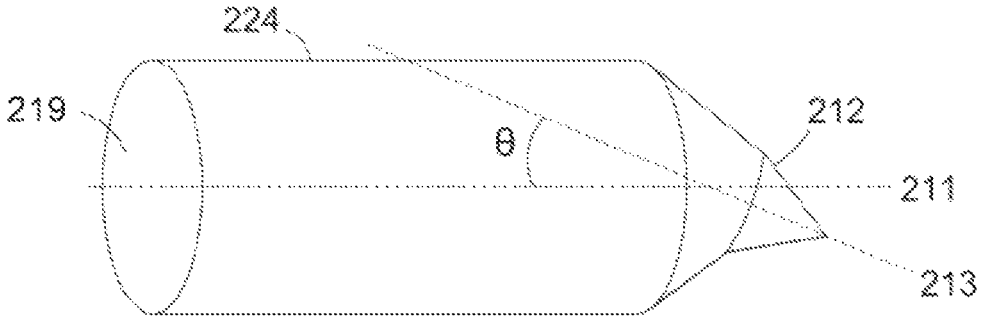
FIG. 4 shows a side view schematic example strike element.

With reference to FIG. 4, an example strike element 210 comprises a strike tip 212 joined to an end of a support body 219 having a portion 224 for functioning as an insertion shank (i.e. for insertion into a bore of a base). The end of the support body is angle so that the strike tip axis 213 is at a compensation angle θ to the axis 211 of the support body 219. The compensation angle θ compensates for an original offset angle imposed by the combination of the base (not shown) and the pick holder (not shown) such that the strike tip axis 213 will be oriented in increased alignment with the strike plane when the support body 219 is mounted on the base as in use. The compensation angle θ may be selected to compensate fully for the original offset angle.

To aid the positioning of the strike element 210 in the correct orientation required to align the strike tip axis 213 with the strike plane, the insertion shank 224 and the base bore (not shown) may be shaped to cooperate and only allow the insertion of the insertion shank 224 into the base bore when it is in the correct orientation. To this end, the insertion shank 224 may be cylindrical in shape but have a flat down one side, or a guide mechanism may be provided for the insertion shank 224.

The strike element 210 with a compensation angle θ can be readily used in pre-existing pick assemblies that are configured so that an insert without a compensation angle would have a strike tip axis that is offset from the strike plane. Such an offset may be dictated by how the pick holder, base and strike element are interconnected and how the pick holder base is attached to a drive apparatus that drives the strike tips in a strike plane when in use.

Compensating for the offset in pre-existing pick assemblies by using strike elements 210 of the present disclosure is likely to reduce the cost of changing from systems that rotated the strike tip, and so required the axis of the strike tip to be aligned out of the strike plane, to systems enabled by this disclosure. The systems enabled by this disclosure are likely to increase pick efficiency by increasing the alignment of the axis of the strike tip with the strike plane, possibly aligning the strike tip axis in the strike plane, while using prior art pick holders and bases. Using strike elements of the present disclosure to replace prior art strike elements will result in these stated features.

Figure 5A:
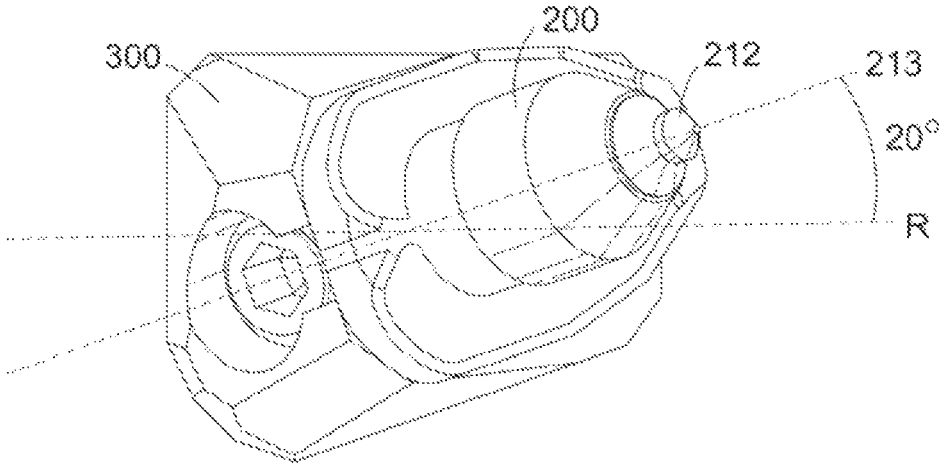
FIG. 5A and FIG. 5B are schematic plan views of part of example pick assemblies.
Figure 5B:
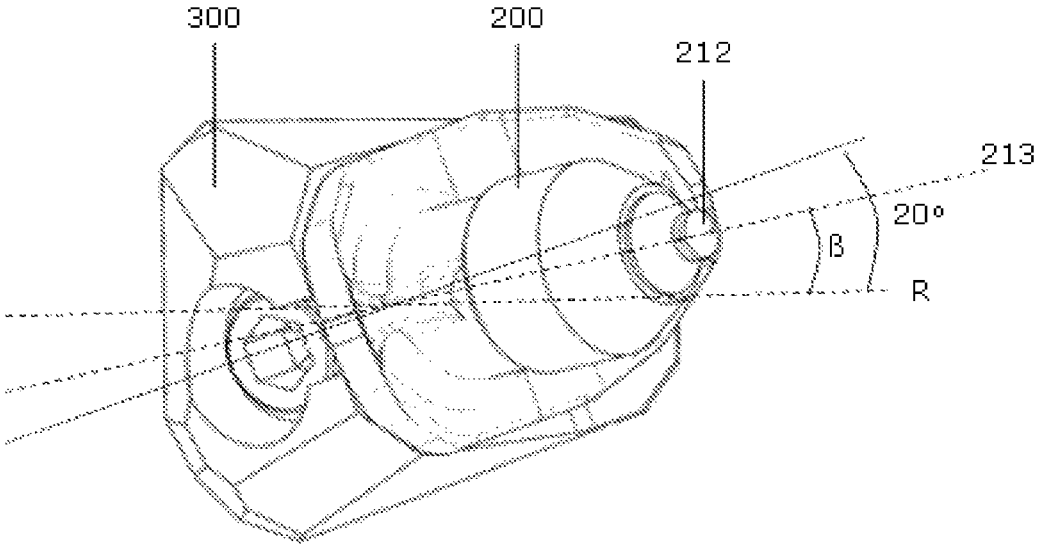

FIG. 5A shows a plan view of part of an example pick assembly comprising a pick tool 200 mounted onto a pick holder 300. The strike tip axis 213 is at an angle of 20 degrees to a reference direction R. FIG. 5B depicts a plan view of a pick assembly using a pick tool according to this disclosure, with a compensation angle to adjust the alignment of the strike tip axis 213. The strike tip axis 213 of a pick assembly shown in FIG. 5B is at an angle β of 13 degrees with respect to the reference direction R. These different degrees of compensation can bring the strike tip 212 into increased alignment with the strike plane and increase the picking efficiency.

Utilisation of the strike element bases, strike elements, pick tools, and pick assemblies of the present disclosure increases the ease with which a number of strike tip configurations can be incorporated when using a plurality of pick tools on a drive apparatus, such as a rotatable drum. This disclosure allows the adjustment of individual strike tip orientations with respect to the strike plane, increasing the flexibility in drive apparatus design based on pre-existing pick assembly arrangements. Therefore, a plurality of pick tools on a drive apparatus may have varying strike tip axis alignments, at least some being adjusted by the use of strike elements or bases described herein.

It is also possible to achieve the features of the present disclosure by adjusting the pick holder 300 to compensate the offset angle. This can be achieved by adjusting the pick holder bore that receives the base shaft 222 of the base in an analogous way to that described above. Further, it is possible to compensate for the offset angle by adjusting how the pick holder 300 is fitted to a drive apparatus, such as a drum.

The pick holder, the base and the strike element may all be connected so that they are all aligned and the orientation of the pick holder relative to the strike plane in the orientation of the strike tip axis relative to the strike plane. In this situation, the base and the strike element do not cause an adjustment of the strike tip axis's alignment relative to the strike plane. Therefore, the strike tip axis is aligned with the strike plane by the pick holder being connected to the drive apparatus so that the whole assembly, and therefore the strike tip axis, is aligned with the strike plane.

It is possible to use the various compensating components described in combination to achieve the overall effect of bringing the strike tip axis into increased alignment with the strike plane. In other words, the complete compensation desired to increase alignment of the strike tip axis with the strike plane may not be carried out by just one compensating component.

Also, it would be possible to use these analogous compensating components to adjust the strike tip axis to be at any angle with respect to the strike plane.

The compensation angle may have the effect of increasing the alignment of the strike tip axis with the strike plane. This increase in alignment is likely to result in an increase in pick efficiency. However, it may result in an increase in wear. Pick insert bases, strike elements, pick tools and pick assemblies of this disclosure allow the adjustment of this trade off between strike tip wear and pick efficiency. The strike element bases, strike elements, pick tools and pick assemblies of the present disclosure may result in the strike tip axis being aligned at an angle relative to the strike plane of less than 5 degrees, less than 4 degrees or less than 3 degrees, or in substantial or complete alignment of the strike tip axis with the strike plane.

Use of a super-hard strike tip, particularly diamond in the form of PCD, results in a reduction in wear of the strike tip. For strike tips comprising a super-hard material, the primary mode of failure is fracture rather than wear and so the use of super-hard materials allows the strike element bases, strike elements, tools and assemblies of the present disclosure to benefit from the increased picking efficiency associated with the strike tip having an increased alignment with the strike plane, while negating the disadvantage of uneven, or increased, wear of the strike tip that may occur with strike tips that do not comprise super-hard material. While wanting not to be bound by a particular theory, pick assemblies in which the strike tip comprises super-hard material are likely to wear in use substantially more slowly than pick assemblies in which the strike tip consists of carbide material, and therefore it may not be necessary to configure the pick such that the strike tip will rotate about the strike tip axis in use (in order for the strike tip to wear more evenly). If it is not necessary for the strike tip to rotate in use then it is not necessary for the strike tip to be misaligned with the strike plane by an offset angle (such misalignment serving to induce a rotational moment on prior art strike tips). Therefore, when the strike tip comprises super-hard material its axis can be aligned with the strike plane and consequently the efficiency of the pick is likely to be enhanced.

The support body of the strike element may comprise cemented carbide. The base may comprise steel.

Methods of assembling the strike element, pick tools and pick assemblies of the present disclosure are also provided.

The strike tips may be bonded to the support body to form the strike elements of the present disclosure. The strike tips may be brazed to the support body.

The strike elements may be inserted into the base bore. The strike element may be press fitted into the base bore. Alternatively, the strike element may be shrink fitted by heating or cooling the strike element or the base and using the thermal expansion/contraction to aid insertion and result in a secure fit on return to ambient temperature.

The strike element is inserted into the base bore so that at least the strike tip protrudes out of the base. The frusto-conical portion of the strike element's support body may protrude from the base bore. The strike element may be inserted into the base bore until it abuts a seat within the base bore and can be inserted no further.

The base's shaft is inserted into the pick holder bore in order to secure the base to the pick holder. The shaft may be releasably connected to the pick holder, possibly by means of a grub screw located in the pick holder.

The pick holder may be welded to the drive apparatus, such as a drum, for driving the pick tool.

In operation, the pick tool may be driven forward by a drive apparatus on which it is mounted, against a structure to be degraded and with the strike tip at the leading end. For example, a plurality of pick tools may be mounted on a drum for asphalt degradation, depicted in FIG. 2, as may be used to break up a road for resurfacing. The drum is connected to a vehicle and caused to rotate. As the drum is brought into proximity of the road surface, the pick tools are repeatedly impacted into the road as the drum rotates and the leading strike tips thus break up the asphalt. A similar approach may be used to break up coal formations in coal mining.

The strike element bases, strike elements, pick tools and pick assemblies of the present disclosure may be used to temporarily adjust the offset angle of the strike tip axis. This means that the same system may be used with the offset angle of individual strike tip axes being adjusted as required. In particular, a compensating component of the present disclosure may be used to decrease the offset angle when using strike tips with good wear characteristics, such as strike tips comprising PCD. This will increase the pick efficiency while not compromising significantly on wear characteristics due to the strike tip's inherently good wear properties. Alternatively, the offset angle may be temporarily increased when using strike tips with less favourable wear properties, such as strike tips comprising cemented carbide. This will improve the wear characteristics of the strike tip in use when using these relatively inexpensive strike tips.

It is possible to use components analogous to those described herein to provide an offset angle in systems where there is no offset angle. Such a zero-offset system is described above where the pick holder, the base and the strike element are all connected to be aligned relative to the strike plane. In these systems the orientation of the pick holder relative to the strike plane is the orientation of the strike tip axis relative to the strike plane. Therefore, the base and the strike element are not causing an adjustment of the strike tip axis's alignment relative to the strike plane, instead the alignment of the strike tip axis is dictated by how the pick holder is connected to the drive apparatus. The provision of an offset angle in such systems by using components analogous to those described herein could be useful when replacing strike tips with good inherent wear characteristics with strike tips with less favourable inherent wear characteristics, the strike tips with less favourable inherent wear characteristics benefiting from an offset angle when in use. In this way, the flexibility of a given system is increased.

The alignment of the strike tip's axis may be adjusted due to the characteristics of the body being degraded by the strike tips. For example, if a section of road being degraded contains metal items, or other hard bodies, relatively aligned PCD strike tips may be temporarily removed and temporarily replaced with the relatively misaligned cemented carbide strike tips. This would reduce the risk of damaging the relatively expensive PCD strike tips, which are more prone to failure by fracture. Conversely, the relatively aligned PCD strike tips may temporarily replace the relatively misaligned cemented carbide strike tips when an increased picking efficiency is desired.

The following clauses are offered as further description of the disclosed pick tools.

1. A strike element comprising a strike tip and a support body, the support body comprising an insertion shank, wherein an axis of the insertion shank is offset at an angle to an axis of the strike tip.
2. A pick tool comprising a strike element and a base, the strike element comprising a strike tip and a support body, the support body further comprising an insertion shank; wherein in use the strike tip is constrained to travel in a strike plane and an axis of the strike tip lies substantially in the strike plane.
3. The pick tool of clause 2, wherein an axis of the insertion shank is offset at an angle to the axis of the strike tip.
4. The strike element or the pick tool of any one of the preceding clauses, wherein the insertion shank is offset at an angle of between 5 degrees and 20 degrees to the axis of the strike tip, and preferably offset at an angle of about 7 degrees.
5. The pick tool of clause 2, wherein an axis of the insertion shank lies substantially in the strike plane.
6. The pick tool of any one of clauses 2 to 4, wherein an axis of the insertion shank lies out of the strike plane.
7. The pick tool of any one of clauses 2 to 6, wherein the base comprises steel.
8. The pick tool of any one of clauses 2 to 7, wherein the base further comprises a shaft for connection to a pick holder.
9. The strike element or the pick tool of any one of the preceding clauses, wherein the strike tip comprises a super-hard material.
10. The strike element or pick tool of clause 9, wherein the super-hard material comprises at least one of natural diamond, synthetic diamond and cubic boron nitride.
11. The strike element or the pick tool of any preceding clause, wherein the support body comprises a cemented carbide material.
12. The strike element or the pick tool of any preceding clause, wherein the axis of the strike tip is an axis extending substantially through the centre of a strike tip base and a strike tip apex.
13. The strike element or the pick tool of any preceding clause, wherein the support body further comprises a conical portion and an axis of the conical portion is coincident with the axis of the strike tip.
14. The strike element or pick tool of clause 13, wherein the conical portion is frusto-conical.
15. The strike element or the pick tool of any preceding clause, wherein the axis of the insertion shank is a longitudinal axis.
16. A pick apparatus comprising a pick holder, wherein at least one strike tip or pick tool as defined in any one of the preceding clauses is mounted on the pick holder.
17. A pick assembly comprising a pick tool and a pick holder for driving the pick tool in a strike plane in use; the pick tool comprising a strike tip attached to a base, the strike tip defining a longitudinal axis; the pick holder and the base being cooperatively configured for mounting the pick tool on the pick holder operable to the strike tip longitudinal axis being substantially aligned with the strike plane.
18. The pick assembly or apparatus of clause 16 or 17, wherein the pick holder is connected to a drive apparatus.
19. The pick assembly or apparatus of clause 18, wherein there is a plurality of pick holders connected to the drive apparatus.
20. The pick assembly or apparatus of clause 18 or 19, wherein the drive apparatus comprises a drum.
21. A method of manufacturing a strike element comprising the steps of forming a support body that comprises an insertion shank and bonding a strike tip to the support body so that an axis of the strike tip is offset at an angle to an axis of the insertion shank.
22. The method of manufacturing a pick tool comprising the steps of forming a support body that comprises an insertion shank; bonding a strike tip to the support body; and inserting the insertion shank into a base, such that in use the strike tip is constrained to travel in a strike plane and an axis of the strike tip lies substantially in the strike plane.
23. The method of clause 21, wherein the insertion shank and base are formed to ensure that, upon insertion of the insertion shank into the base, the strike tip assumes a position where the axis of the strike tip is substantially in the strike plane.

24. The method of any one of clauses 20 to 22, wherein the support body is formed to have a conical portion and the strike tip is bonded to the conical portion so that the axis of the strike tip and an axis of the conical portion are coincident.
25. A method of manufacturing a pick apparatus comprising the steps of the method of manufacturing a pick tool of any one of clauses 21 to 23; joining the base onto a pick holder; and joining the pick holder to a drive apparatus for driving the pick tool such that when the strike tip is driven it travels in the strike plane and the pick tool is positioned so that the axis of the strike tip lies substantially in the strike plane.
26. The method of clause 24, wherein the pick tool is welded to the pick holder and/or the pick holder is welded to the drive apparatus.
27. The method of clause 24 or 25, wherein the base is formed to have a shaft and the method comprises the further step of forming a bore in the pick holder and inserting the shaft into the bore.
28. The method of clause 26, wherein the shaft and bore are formed to ensure that the strike tip assumes a position where the axis of the strike tip is substantially in the strike plane.
29. A method of assembling a pick tool on a drive apparatus, comprising: inserting a strike element having a strike tip axis into a base having a base; and attaching the base to the drive apparatus; wherein the base and drive apparatus are shaped for complementary engagement and the pick inset is shaped to be constrained such that the strike tip axis lies substantially in an intended strike plane of the drive apparatus.
30. The method of clause 28, wherein the strike element includes a shank offset from the strike tip axis for insertion into the base.
31. The method of clause 28 wherein the strike element includes a shank having an axis which is aligned with the strike tip axis.
32. The method of any one of clauses 28 to 30, wherein the base defines a shaft for receiving the strike element, the shaft being orientated to cause the strike tip axis to be aligned with the strike plane.
33. The method of any one of clauses 28 to 31, wherein the strike element is held in the base by means of a grub screw.
34. The method of any one of clauses 28 to 32, wherein the base is welded to the drive apparatus.

Certain terms as used herein will be briefly explained below.

As used herein, "super-hard" material has a Vickers hardness of at least 25 GPa. Synthetic and natural diamond, polycrystalline diamond (PCD), cubic boron nitride (cBN) and polycrystalline cBN (PCBN) material are examples of super-hard materials. Synthetic diamond, which is also called man-made diamond, is diamond material that has been manufactured. A polycrystalline super-hard structure comprises a sintered mass of super-hard grains, a substantial fraction of which may be directly, or coherently, bonded to neighbouring grains. A PCD structure comprises or consists essentially of PCD material and a PCBN structure comprises or consists essentially of PCBN material.

Other examples of super-hard materials include certain composite materials comprising diamond or cBN grains held together by a matrix comprising ceramic material, such as silicon carbide (SiC), or cemented carbide material, such as Co-bonded WC material (for example, as described in U.S. Pat. No. 5,453,105 or 6,919,040). For example, certain SiC-bonded diamond materials may comprise at least about 30 volume per-cent diamond grains dispersed in a SiC matrix (which may contain a minor amount of Si in a form other than SiC). Examples of SiC-bonded diamond materials are described in U.S. Pat. Nos. 7,008,672; 6,709,747; 6,179,886; 6,447,852; and International Application publication number WO2009/013713).

The invention claimed is:

1. A pick assembly comprising:
a rotatable drive means,
a pick holder attached to the rotatable drive means, and
a pick tool, comprising
a base having a shaft; and
a strike element comprising a strike tip comprising superhard material, the strike tip defining a strike tip axis and capable of being attached to the base, the strike element and the base capable of being attached to the pick holder via insertion of the shaft of the base within a bore of the pick holder;
the pick holder and the pick tool being configured in relation to the drive means operative to the strike tip axis being oriented to within a strike angle of at most 2 degrees with a strike plane on which the strike tip will travel when driven by the drive means;
in which the pick holder is attached to the drive means such that the pick holder is misaligned from the strike plane by an offset angle of at least 5 degrees and in which the shaft of the base is configured such that when the pick tool is attached to the pick holder, the offset angle is compensated such that strike tip axis is oriented to within a strike angle of at most 2 degrees with the strike plane.

2. The pick assembly as claimed in claim 1, in which the strike tip axis is aligned with the strike plane when the pick assembly is assembled as in use.

3. The pick assembly as claimed in claim 1, in which the strike element is non-rotatably attached to the base.

4. The pick assembly as claimed in claim 2, in which the strike element is non-rotatably attached to the base.

5. The pick assembly as claimed in claim 1, in which the strike tip has opposite ends connected by a peripheral side surface and the strike tip axis passes through both ends, concentric with the peripheral side surface.

6. The pick assembly as claimed in claim 1, in which the strike tip is rotationally symmetrical about the strike tip axis.

7. The pick assembly as claimed in claim 1, in which the strike tip comprises a conical surface and rounded apex and the strike tip axis passes through the apex.

8. The pick assembly as claimed in claim 1, in which the strike element comprises the strike tip joined to an elongate support body and the base comprises a bore for accommodating the support body, the support body securable in the bore by means of an interference fit.

9. The pick assembly as claimed in claim 1, in which the super-hard material is diamond, cubic boron nitride (cBN), silicon carbide bonded diamond (SCD) material or polycrystalline diamond (PCD) material.

10. The pick assembly as claimed in claim 1, in which the strike tip comprises a super-hard strike structure joined to a cemented carbide substrate, the strike structure defining a working end having a conical surface region and a rounded central apex.

11. The pick assembly as claimed in claim 1, in which the drive means is a drum configured to be driven by a vehicle.

12. The pick assembly as claimed in claim 1, in which the pick assembly is for road milling or mining.

13. The pick assembly as claimed in claim 1, in which the strike element comprises the strike tip joined to a support body and is configured such that the strike tip axis is oriented at a non-zero angle from an axis defined by the support body such that when the pick assembly is in assembled as in use, the strike tip axis is oriented to within a strike angle of at most 5 degrees with the strike plane.

14. The pick assembly as claimed in claim 1, in which the strike tip comprises polycrystalline diamond (PCD) material joined to a carbide substrate, the strike element comprises the strike tip joined to a support body comprising an elongate insertion shank; the base comprises steel and has a bore for accommodating the insertion shank and holding it by means of an interference fit.

15. The pick assembly as claimed in claim 1, comprising a plurality of pick tools attached to a drum for mining or road milling by means of a respective plurality of pick holders.

16. The pick assembly as claimed in claim 15, in which at least some of the pick assemblies are arranged such that the respective strike tip axes are oriented to within different strike angles of at most 5 degrees with the strike plane.

17. A pick tool for a pick assembly as claimed in claim 1, the pick tool configured such that the strike tip is aligned with the strike plane when the pick assembly is assembled as in use.

18. A strike element for a pick assembly as claimed in claim 1, the strike element configured such that the strike tip axis is aligned with the strike plane when the pick assembly is assembled as in use.

* * * * *